US007023307B2

(12) United States Patent
Dooley

(10) Patent No.: US 7,023,307 B2
(45) Date of Patent: Apr. 4, 2006

(54) ELECTRO-MAGNETICALLY ENHANCED CURRENT INTERRUPTER

(75) Inventor: Kevin Allan Dooley, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 43 days.

(21) Appl. No.: 10/701,525

(22) Filed: Nov. 6, 2003

(65) Prior Publication Data

US 2005/0099250 A1 May 12, 2005

(51) Int. Cl.
*H01H 53/00* (2006.01)

(52) U.S. Cl. ..... 335/147; 335/47; 335/57; 361/115

(58) Field of Classification Search ..... 337/142, 337/220, 163–166, 227, 401–407; 335/147, 335/47, 58; 361/115, 124, 126
See application file for complete search history.

(56) References Cited

U.S. PATENT DOCUMENTS

| | | | | |
|---|---|---|---|---|
| 2,018,556 | A | 10/1935 | Hope | |
| 3,123,694 | A | 3/1964 | Kozacka | |
| 3,867,597 | A | 2/1975 | Jawelak et al. | |
| 4,368,452 | A | 1/1983 | Kerr, Jr. | |
| 4,489,301 | A | 12/1984 | Johnson et al. | |
| 4,533,895 | A | 8/1985 | Kowalik et al. | |
| 4,622,534 | A | 11/1986 | Bowman | |
| 4,633,207 | A | 12/1986 | McClellan et al. | |
| 4,689,598 | A | 8/1987 | Ishikawa et al. | |
| 4,870,386 | A | 9/1989 | Arikawa | |
| 5,084,691 | A | 1/1992 | Lester et al. | |
| 5,604,400 | A | 2/1997 | Altmaier et al. | |
| 5,608,297 | A | 3/1997 | Goebel | |
| 5,673,014 | A | 9/1997 | Domanits | |
| 5,781,394 | A | 7/1998 | Lorenz et al. | |
| 5,831,507 | A * | 11/1998 | Kasamatsu et al. | 337/4 |
| 5,903,041 | A | 5/1999 | La Fleur et al. | |
| 6,075,434 | A | 6/2000 | Rueckling | |
| 6,201,679 | B1 | 3/2001 | Richiuso | |

FOREIGN PATENT DOCUMENTS

| | | |
|---|---|---|
| CA | 2190417 | 5/1997 |
| EP | 0 774 887 A2 | 5/1997 |
| FR | 2.014.391 | 4/1970 |

OTHER PUBLICATIONS

Bibliographic data in English from Espacenet and machine translation in English of EP0774887.
PCT International Search Report, PCT CA2004, 001020—Mailed Sep. 23, 2004.
Summary of French Patent Application No. 2,014,391.

* cited by examiner

*Primary Examiner*—Lincoln Donovan
(74) *Attorney, Agent, or Firm*—Ogilvy Renault

(57) ABSTRACT

The present invention provides an apparatus and method of interrupting the current in a circuit wherein the magnetic pressure induced by current flow through a conductor causes the conductor to flow and thereby open the associated circuit. Magnetic pressure may be derived from Lorenz equations. Gravity is not relied upon to cause the conductor material to flow. The invention may be used in circuits having high currents relative to conductor size and material selection.

9 Claims, 6 Drawing Sheets

ELECTRO-MAGNETICALLY ENHANCED CURRENT INTERRUPTER

FIELD OF THE INVENTION

The invention relates to a current interrupter for an electrical circuit, and in particular one which is well-suited for use with a high-current circuit.

BACKGROUND

A typical meltable fuse-type electrical interrupter includes a conductor portion which melts upon reaching a threshold current, the melting being caused by the increase in temperature associated with the current increase and the accompanying $I_2R$ effect. Once melted, the molten conductor flows, as a result of gravity and/or surface tension, away from the related conductors and the fuse thereby opens the circuit. Devices of this sort are generally described in U.S. Pat. No. 4,368,452 to Kerr Jr. and U.S. Pat. No. 4,622,534 to Bowman.

Such fuse devices, however, are unsuitable for high current use. As currents increase, so too does the fusing temperature and, at very high currents, the fusing material will vapourize once the threshold current is reached, since the material cannot be removed from the vicinity quickly enough and electricity continues to flow through the molten conductor. Arcing results and, as arcing may continue to occur through the medium of the vapourized conductor, arc-extinguishing measures such as the provision for silica sand or a gas must be provided to permit the device to work as intended in high current circuits. The devices therefore often end up being complex, expensive, heavy and of decreased reliability.

Another drawback of the meltable fuse type interrupter is that gravity is relied upon to remove the melted conductor from the circuit to thereby open the circuit. In applications where fuse attitude or gravity may vary (e.g. airborne or space applications), these types of meltable fuses may also be unsuitable. Also, reliance on gravity slows response times. Accordingly, there is a need for improvements in interrupters, particularly for use in high current-carrying circuits and/or variable attitude applications, and it is an object of this invention to provide such a device.

SUMMARY OF THE INVENTION

In one aspect the invention provides a current interrupter for an electrical circuit, the interrupter adapted to open when a threshold current passes therethrough, the interrupter comprising a flowable conductor adapted for connection to the circuit, the conductor having a cross-sectional area, wherein the conductor cross-sectional area is sized relative to the threshold current such that a sufficient magnetic pressure is generated in the conductor to thereby force the conductor to flow, said flow being sufficient to thereby open the circuit. In a second aspect the invention provides a current interrupter for an electrical circuit, the interrupter adapted to open when a threshold current passes therethrough the interrupter comprising: pressure means for forcing a flowable conductor connected to the circuit to flow sufficiently to thereby open the circuit, said pressure means comprising a conductor and a threshold current, the conductor sized and composed of a material such that the threshold current passing through the conductor generates a temperature and a forcing pressure sufficient to force said flow, said forcing pressure having a greater motive effect on said flow than a gravitational effect on said flow. In another aspect the invention provides a method of providing a current interrupter having at least a conductor adapted to be physically altered to thereby open an associated circuit when a threshold current from the circuit passes through the conductor, the method comprising the steps of: selecting a conductor material the material having a flow temperature above which the conductor flows; selecting a conductor cross-section are; and determining said threshold current, wherein the threshold current is sufficient to raise a conductor temperature to at least the flow temperature at a location corresponding to the cross-section area, and wherein the threshold current induces sufficient pressure in the conductor to cause a sufficient amount of the conductor material to cause an open circuit. In another aspect, the invention provides a method of providing a current interrupter comprising the steps of: a) selecting an interrupter configuration having a conductor; b) selecting a material for the conductor, a cross-sectional area for the conductor and a desired threshold current at which current interruption is desired; c) determining a temperature above which the conductor is in a flowable state; d) determining a magnetic pressure associated with the threshold current passing through the conductor; e) determining a pressure required to cause the conductor to flow in the interrupter configuration when the conductor is in the flowable state; f) comparing the magnetic pressure with the pressure required to determine if the magnetic pressure exceeds the pressure required; and then g) providing an interrupter according to the selections made in steps a) and b), wherein in step f) if the magnetic pressure does not exceed the pressure required then at least one of steps a) and b) and at least one of steps c), d) and e) and at least step f) are iterated until a condition that the magnetic pressure exceeds the pressure required is met, and wherein the condition is met before step g) is performed. In yet another aspect the invention provides a method of interrupting a current in a circuit when a threshold current passes through a conductor of the circuit the method comprising the steps of: providing a conductor made of a conductor material; providing a current through the conductor, wherein the current is sufficient to raise the conductor temperature to a temperature at which the conductor material flows, and wherein the current is sufficient to induce a pressure large enough to cause the conductor to flow and thereby interrupt the circuit. In a further aspect, the inyention provides a method of interrupting a current, in a circuit when a threshold current passes through a conductor of the circuit, the method comprising the steps of; providing a threshold current through the conductor; providing a flowable state to the conductor; and providing sufficient magnetic pressure in the conductor to cause the conductor flow accordingly and thereby interrupt the circuit, wherein the magnetic pressure is induced by current passing through the conductor. In another aspect, the invention provides a method of providing a current interrupter for a circuit, the method comprising the steps of: determining a desired threshold current; selecting a conductor material having a flow temperature above which the conductor will flow; selecting a conductor cross-sectional size; determining a magnetic pressure associated with the threshold current, the conductor material and the conductor cross-sectional size; determining a threshold conductor temperature resulting from the threshold current passing through the conductor material; ensuring the conductor threshold temperature exceeds the conductor flow temperature; and ensuring that the magnetic pressure is sufficient when the threshold current passes through the conductor to thereby force the conductor material to flow to interrupt the circuit.

BRIEF DESCRIPTION OF THE DRAWINGS

For a better understanding of the present invention and to show more clearly how it may be carried into effect, reference will now be made by way of example to the accompanying drawings, in which.

DETAILED DESCRIPTION OF THE PREFERRED EMBODIMENTS

Figure 1:
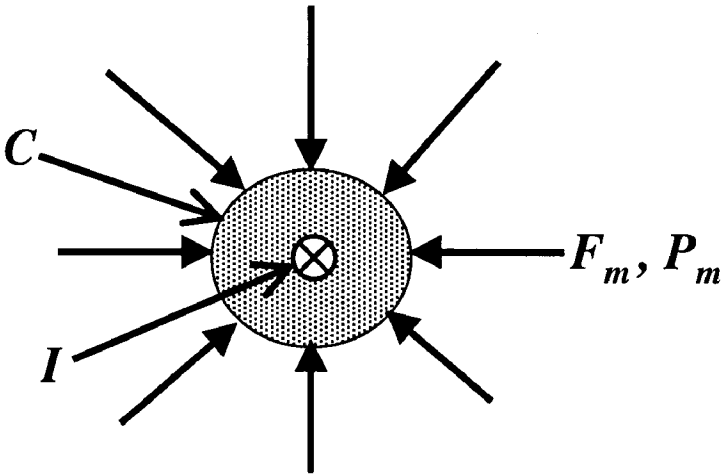
FIGS. 1 and 2 are schematic views of a simple conductor, viewed as lateral and axial cross-sections, respectively.
Figure 2:
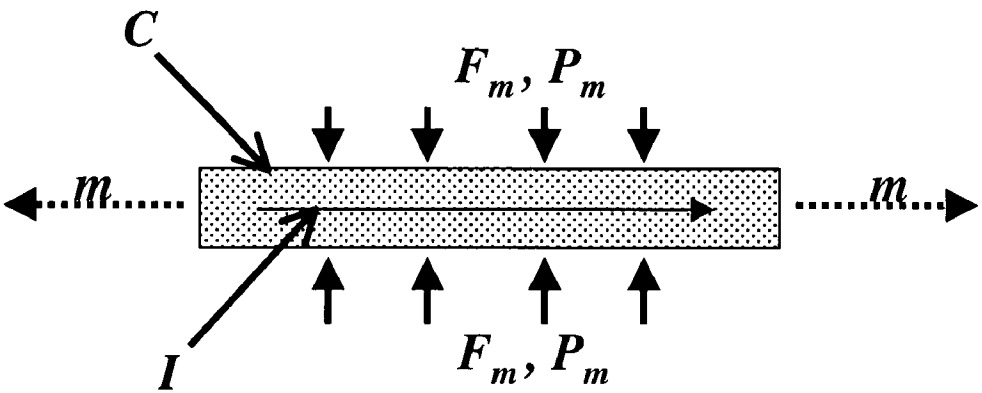

The present invention makes use of a magnetic force related to current flow through a conductor, which may be used to move a such a conductor when in a molten or liquid state. Referring to FIG. 1, when a current I flows through a conductor C (in a direction into the page, in this example), magnetic forces $F_m$ generated as a result of current flow through the conductor act on the conductor in a constrictive and compressive direction. Referring to FIG. 2, the net force acting on the conductor results pressure $P_m$ within conductor C which tends to want to cause flowing of the conductor in a direction m generally normal to the direction of $F_m$, in this case, an axially outward direction. The pressure $P_m$ can be derived from Lorenz equations and may be expressed simply as $$P_m = I^2 * K * \mu / \pi R^2 \qquad \text{(Equation 1)}$$

where, $P_m$ is pressure [Pa], I is current [A], $K=\mu_0/4\pi$ (where $\mu_0$ is the permeability of free space, or 1.257 e-6), $\mu$ is the permeability of the conductor relative to $\mu_0$ at its melted condition, and $\pi R^2$ is the cross-sectional area of the conductor [$m^2$] (where R is the radius of the conductor [m]).

EXAMPLE 1

A 0.080 inch (2 mm) diameter conductor with a permeability $\mu=1.0$ will develop a magnetic pressure of about 4 psi (27.5 kPa) at 1000 A.

EXAMPLE 2

A 0.062×0.125 inch (1.5×3 mm) lead-silver solder conductor material (melting temperature 315° C.) connected to adjacent copper conductors (i.e. in a configuration like that shown in FIG. 3) can be made to rupture according to the present invention at approximately 800 A.

The force $F_m$ and the pressure $P_m$ is greatest at the core of the conductor, while this force and pressure at the outer periphery is zero. Thus the net effect is a axial pumping effect on a liquid conductor, which tends to squeeze the conductor in a manner roughly analogous to a tube of toothpaste being squeezed around its circumference. At normal current levels, the $F_m$ forces are not easily measured nor are they influential on the conductor, however, when the conductor is a fluid (e.g. a melted metal) and $P_m$ is sufficiently high, the magnetic pressure developed as a result can result in motion or flowing of the fluid which the inventor has found may be used in constructing the present interrupter.

The inventor has found that material selection and design configuration will permit the designer to methodically employ the current flow and magnetic interaction in the conductor to 'pinch' or 'pump' a molten conductive fluid, such as a melted link element in an electrical interrupter, to thereby open the associated circuit when a certain threshold current is reached, as will be described further below. In this way, the adverse effects associated with vapourization of prior art fuses can be avoided, since the link material is substantially 'pumped' away before its temperature is elevated to a vapourization temperature. When the current flowing through the conductor is high enough to cause the link material to reach the melting temperature, the core of the now molten conductor tends to flow outward, in both axial directions (see FIG. 2), resulting in a reduction in the diameter of the conductive path. Referring again to Equation 1, it becomes apparent that the motive force $F_m$ or pressure $P_m$ will be inversely proportional to the square of the conductor radius such that, for example, when the conductor radius is diminished by half, the motive pressure increase 4 times, and so on. This results in an ever accelerating flow of the material out of the conduction path. Such an interrupter therefore minimizes the effect of arcing and vapourization simply and by design.

Figure 3:
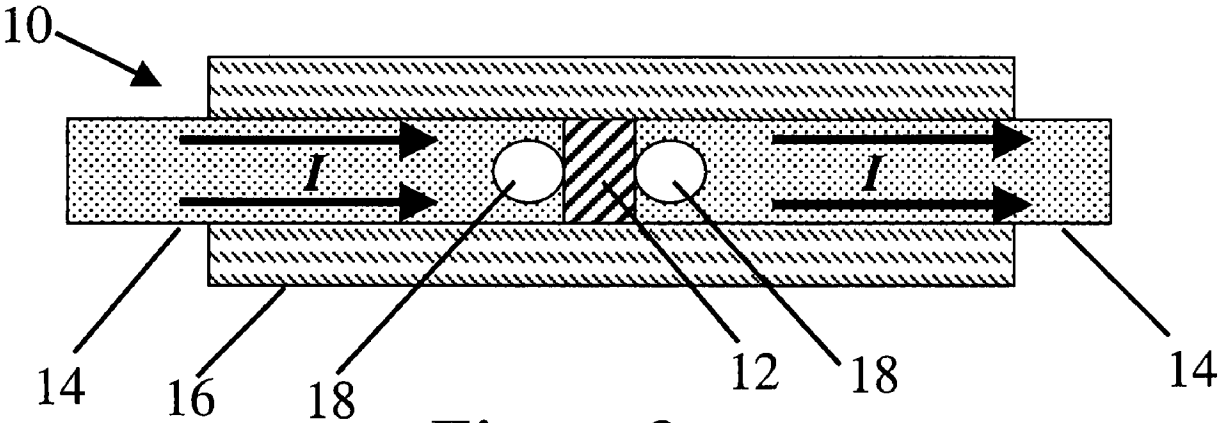
FIG. 3 is a schematic cross-sectional view of an embodiment of the present invention, shown in the "closed" state.

Referring to FIG. 3, an embodiment of an electrical interrupter 10 according to the present invention is shown. The interrupter 10 includes a meltable (preferably) metal link 12 which adjoins two adjacent conductors 14, for conducting current therebetween, and an insulated sleeve 16 surrounding both the conductors 14 and the link 12. Adjacent the link 12 is at least one, and preferably at least two reservoirs 18. Reservoirs 18 are preferably empty in the initial 'closed' state, and are preferably sized to have the same or larger volume as the volume of link 12 in its melted state, as will be described in more detail below. Reservoirs 18 are preferably closely located to link 12 and in fluid communication therewith, and more preferably communicate with link 12 via openings or connecting passages 20 provided to permit fluid communication for molten link material 12' between link 12 and reservoirs 18. Passages 20 preferably communicate with the core or centremost portion of link 12 since, as mentioned above, this is the region of highest pressure $P_m$. Passages 20 are also preferably themselves non-conductive so as not to be subjected their own magnetic pressure effect as a result of current conducted therethrough. Conductors 14 are adapted for connection to an electrical circuit (not shown) in any suitable manner. The reservoirs may be empty in their initial state, or may contain a fluid, such as an arc suppressing fluid, cooling oil or other fluid, which is either displaced by the conductor, or pumped into the conductor's original position, or mixed with the conductor, etc.

In the described embodiment, conductors 14 are of preferably generally rectangular cross-section and are made of copper (any suitable cross-section and conductor material may be used). Link 12 is preferably also of generally rectangular cross-section in this embodiment and is preferably made of a eutectic material, and more preferably Indalloy #182 (a trade mark of the Indium Corporation) having a formulation of 80% Au (Gold) 20% Sn (Tin) and a melting temperature of 280° C. Referring again to Equation 1, Indalloy #182 has a permeability μ of 1.0 (whereas conductive materials containing iron or nickel would be greater than 1). Link 12 and conductors 14 are joined by any suitable means. The link material is selected generally based on its melting temperature corresponding to the selected threshold current, though mechanical properties and oxidation resistance are also desirable to consider. The conductor material is preferably selected, among other things, to remain in its solid state until the threshold current is reached. A eutectic metal material is preferred for its well-controlled melting point and its strong mechanical material properties, however while eutectic materials are preferred, other materials may also be used. It is also possible to design the interrupter 10 to operate based on a pre-selected current, as is presently done with prior art fuses, using power dissipation and heat balance/conduction to the environment to set the temperature at a particular current. Equation 1 will be relevant in selecting the conductor material for link 12.

Reservoirs 18 are preferably two in number and generally cylindrical holes or voids in conductors 14, the volume of these cylinders preferably being approximately equal to or larger than the calculated volume of link 12 when in its molten state. Reservoirs 18 are preferably cut or punched into conductors 14 after conductors 14 have been assembled to link 12, though any method of providing them may be used.

Figure 4:
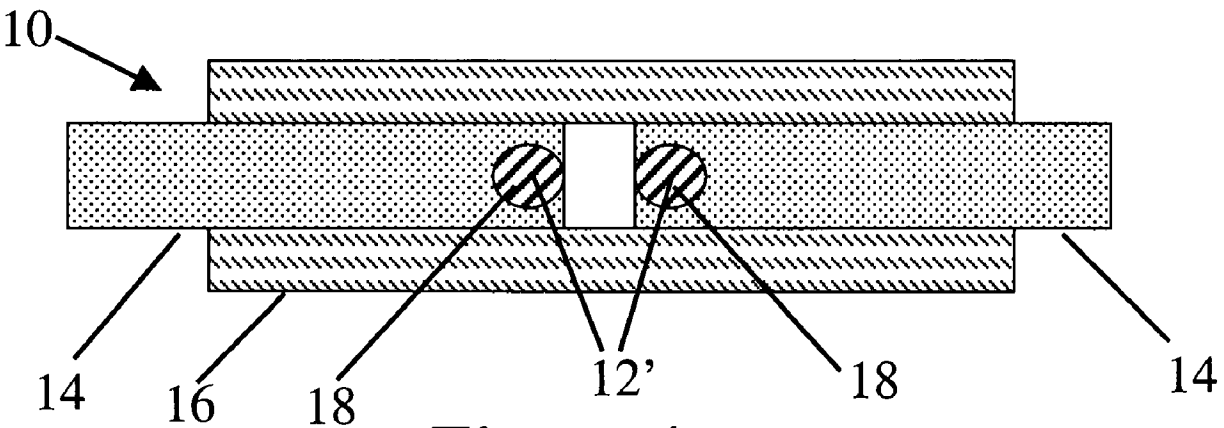
FIG. 4 is the device of FIG. 3, shown in the "open" state.

In use, in normal operating conditions, the current I (indicated by the arrows in FIG. 3) flowing through the electrical circuit (not shown) passes into interrupter 10 through a first conductor 14, around a first reservoir 18, through link 12, around a second reservoir 18 and then through a second conductor 14 and then to the remainder of the circuit. In the event of a current increase in the circuit, the high current flow generates increased heat and magnetic forces in the conductors in current path. Referring to FIG. 4, when the current I is high enough to reach a threshold current $I_{threshold}$, that is, sufficient to generate just enough heat and temperature rise to melt the link 12, the pressure on the circumference of link 12 resulting from the magnetic forces caused by $I_{threshold}$ causes the molten metal 12' of link 12 to be forced under the action of this pressure (see Equation 1) into the spaces provided by reservoirs 18, thereby resulting in a break in the circuit, and thus opening the circuit and preventing current flow. Cooling occurring after the circuit opens results in re-solidification of the link material 12', but in this embodiment the configuration is such that cooling does not allow the fuse to return to a current-conducting state. Note in FIG. 4 that the location of reservoirs 18 need not allow for a gravity feed of link material 12', since gravity is not relied upon in the operation of the interrupter 10.

As mentioned, the present current interrupter takes advantage of an induced pressure to cause the conductor to flow so as to open the associated circuit. Consequently, interrupter 10 should be designed taking expected pressures under consideration, as well as temperatures and conductor state, to ensure that sufficient pressure is provided to cause the conductor to move by flowing. The designer will generally consider the heat generated in the conductor at a given current, the melting point of the conductor, and the pressure losses to be overcome in moving the melted conductor. Pressure considerations which may affect the design include surface tension of the molten conductor, capillary action and viscous losses, as well as losses due to interrupter geometry. The interrupter design is then provided to ensure that both (a) the conductor is in a flowable state, preferably a liquid state, at temperatures corresponding to a desired threshold, and (b) sufficient magnetic pressure is generated to overcome the calculated pressure losses and thereby cause the conductor to flow accordingly (see Equation 1 and Example 1).

As mentioned, the magnetic pressure depends in part on the diameter of the conductor. Therefore, it will be understood that as the cross-sectional area of the conductor is reduced (i.e. as conductor material is 'pumped' away), the magnetic pressure $P_m$ increases at a given current, by the square of the ratio of diameters. Therefore, as conductor flow progresses (it will not generally be instantaneous), magnetic pressure increases. Referring again to Example 1, when the volume of fluid is at the half way point in Example 1, the pressure will be 16 psi (100 kPa). The designer may therefore take advantage of this behaviour to ensure that just enough magnetic pressure and flowable conductor is present to initiate cross-section reduction, after which the corresponding pressure increases will 'kick' the rest of the process. Though pressure is dependent on conductor size, material, etc. the magnetic pressure may be as low as 0.1 or 0.0.2 psi (0.7 or 1.2 kPa, respectively), or lower.

It will be understood that FIG. 4 represents an idealized circumstance in which all of link 12 is melted and flows into reservoirs 18. In practice, however, all that is required in the present invention is that a sufficient amount of link 12 melt and be forced away from adjacent conductor or conductors 14 in an suitable manner to thereby open the interrupter 10 and, thereby, the associated circuit. In practice, the material of conductors 14 may also decay to some extent.

Figure 5:
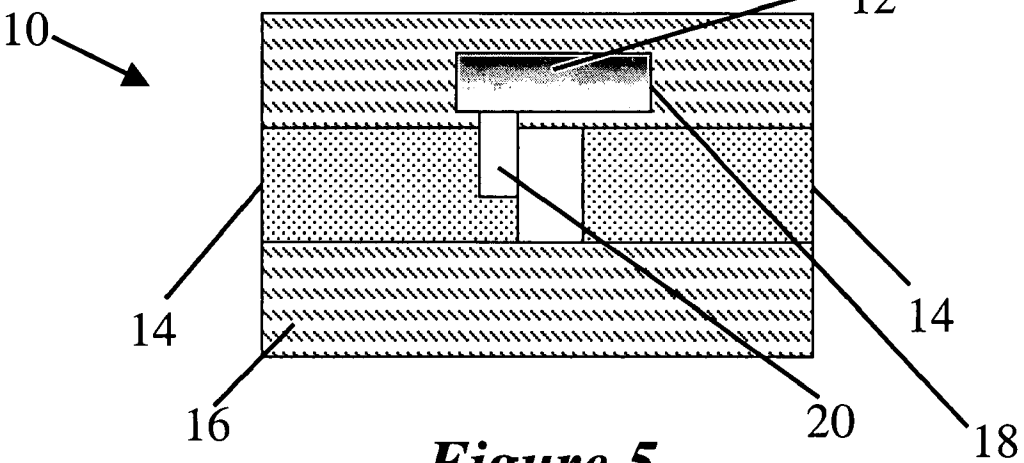
FIGS. 5 and 6 show alternate embodiments of the device of FIG. 3, both in the "open" state.

In another embodiment, depicted in FIG. 5, a single reservoir 18' is provided in a different location, and reservoir 18' is larger than the volume of melted link 12. A connecting passage 20 is provided to provide fluid communication for molten link material 12' between link 12 and reservoir 18'. Note that the reservoir 18 need not be on the 'bottom' side (i.e. closer to the earth) of link 12, since gravity is not a determining factor in the operation of the present invention.

Figure 6:
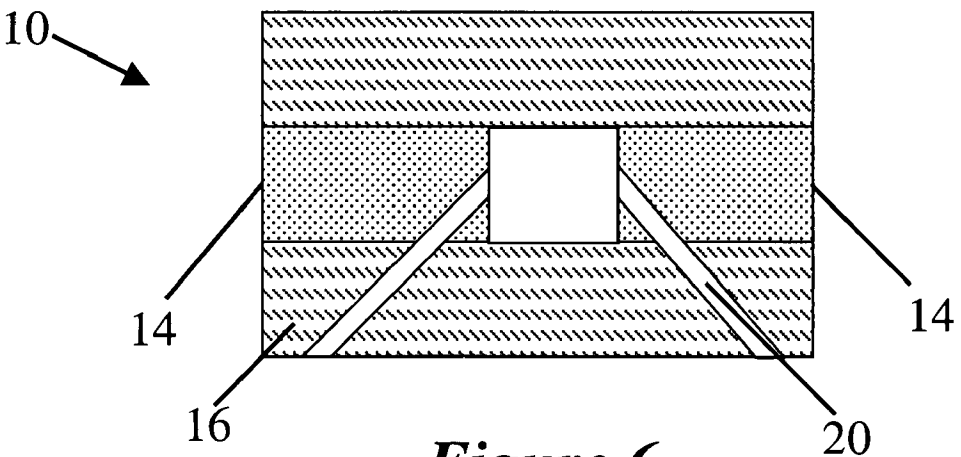

Referring to FIG. 6, in yet another embodiment, reservoir 18 is absent altogether, and link material 12' (not shown) is permitted to be pumped away from the original position of link 12. Again, despite the location of passages 20, the fuse of FIG. 6 can be made to operate satisfactorily in any attitude, since gravity is not relied upon by the present invention.

The present system is an active system which overcomes the drawbacks of prior art passive systems, such as fluid viscosity effects and gravity-feed which result in significantly slower response times. The present invention is therefore particularly well-suited for use with relatively high current circuits which do not require fast fusing (i.e. slow blow fuses). When the device is provided such that the threshold current is sufficiently high, the magnetic pressure at this current will be sufficient to cause the described magnetic phenomenon to 'pump' the melted link as described. At lower currents, the pressure induced will be insufficient to achieve the described result. However, referring again to Equation 1, it will also be understood that what constitutes a 'high' current is dependent on conductor size and composition, among other things. Therefore, applicability of the device is not limited to traditional notions of 'high current', and with the continual development of nanotechnology, the lower current limit to which this invention is applicable may not yet be known.

Figure 7:
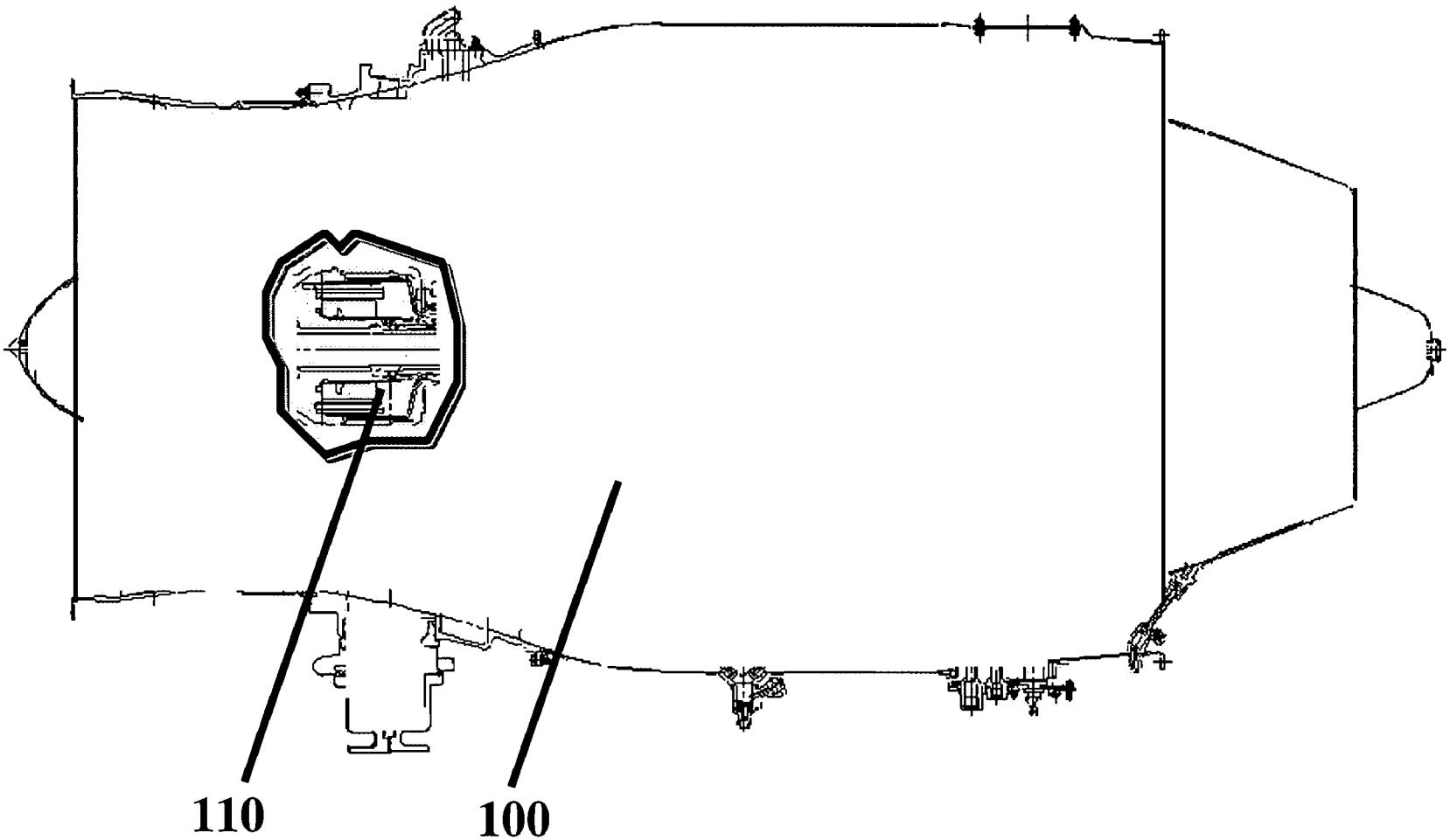
FIG. 7 is a side view of a gas turbine engine with a portion broken away to show an electric machine incorporating the present invention therein.

The present invention is particularly well suited, among other things, to application to protecting an electric machine from damage caused by internal short circuiting. Referring to FIG. 7, such an electric machine 119 is shown in a starter-generator application for a gas turbine engine 100.

Figure 8A:
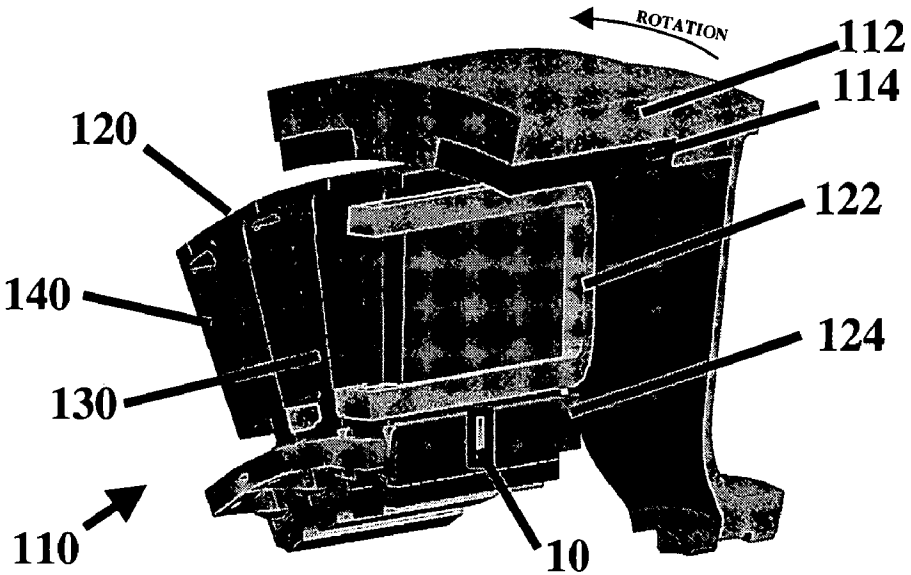
FIGS. 8*a* and 8*b* are enlarged partial isometric and cross-sectional views, respectively, of an example electric machine of FIG. 7.
Figure 8B:
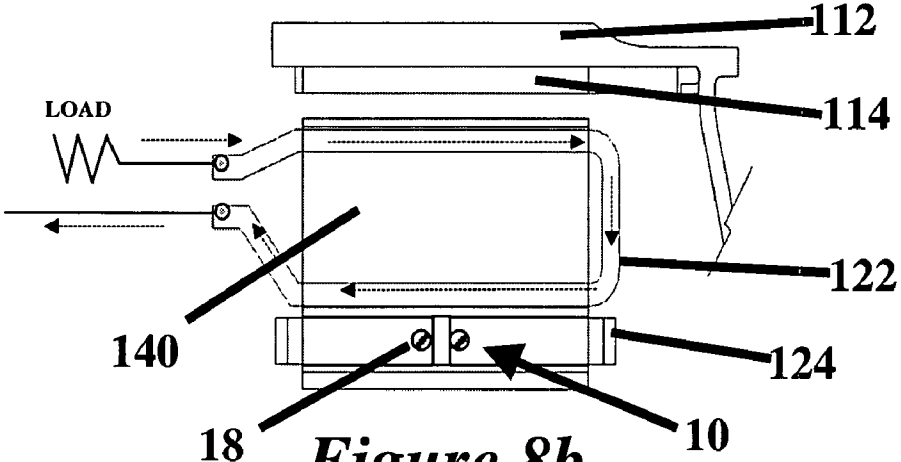

Referring to FIG. 8*a*, the current limiting device 10, may be used beneficially in the secondary or control winding of a permanent magnet alternator of the type described in the applicant's co-pending application Ser. No. 10/444,952, filed 27 May 2003, the contents of which are incorporated by reference into this disclosure. Briefly, FIG. 8*a* shows interrupter 10 according to the present invention provided in one or more legs 142 (preferably all legs) of a secondary winding 124. As described fully in the incorporated reference, in use, as rotor 112 rotates around stator 120, magnets 114 induce a current in primary winding 122. The presence and interaction of primary winding 122, secondary winding 124 and bridge 140 extending between adjacent stator teeth 130 also causes an induced current flow in secondary winding 124. Referring to FIG. 8*b*, in use, when the current in secondary winding 124 exceeds a certain threshold, an interrupter element 10 will "open", by link 12 melting, and link material 12' flowing into reservoirs 18 as described above, and interrupter 10 thereby creating an open-circuit in secondary winding (i.e. no secondary current) and, by reason of the electrical inter-relationship between the primary and secondary circuits, the output current of primary winding 122 will be appropriately controlled. Consequently inductive reactance of the machine is increased, which can be used limit maximum output current to a maximum synchronous impedance of machine 110. Thus, interrupter 10 can be used in the control of the machine's impedance and in providing machine 110 intrinsic thermal protection against a short-circuit in primary winding 122 when operating in an alternator mode.

The present invention also presents the designer with various options in design, unlike the prior art. For example, if for some reason an electrical device including interrupter 10 is operating at normal or low load currents (i.e. there is no electrical fault), but there is a fault which causes overheating in the device (e.g. an interruption of coolant or a very high coolant temperature), the configuration of interrupter 10 may permit the link 12 to melt and escape and thereby open the circuit to stop operation of the device even though no electrical fault is present. Such operation would of course not have the benefit of the magnetic pressure $P_m$ caused by an appropriate current level, but nonetheless permits the designer flexibility in providing thermal protection to the device. Conversely, the designer may provide a configuration in which link 12 does not flow to open the circuit unless there is a sufficient current present to 'pump' away the molten conductor, and in this way the designer may intentionally permit the device to run "hot" as long a threshold current is not exceeded. In yet another situation, the designer may provide cooling to link 12 to reduce the operating temperature of link 12 even though a current passing through link 12 exceeds an 'uncooled' threshold for link 12, which thereby gives the designer flexibility in selecting when and at what current interrupter 10 will operate to open the circuit.

Referring again to FIG. 5, another feature of the present interrupter is that it may be provided in a configuration which is automatically intrinsically re-settable. The conductor material may be heated or reheated such that the molten material may flow back to its original location to reconstitute link 12. Gravity feed may be used, or more preferably, a driving current is used to expulse the conductor material from the reservoir 18 and back into its original location as link 12. Since oxidation, etc. would likely be an issue in such re-settable devices, an oxygen-free environment is preferably provided.

Figure 9A:
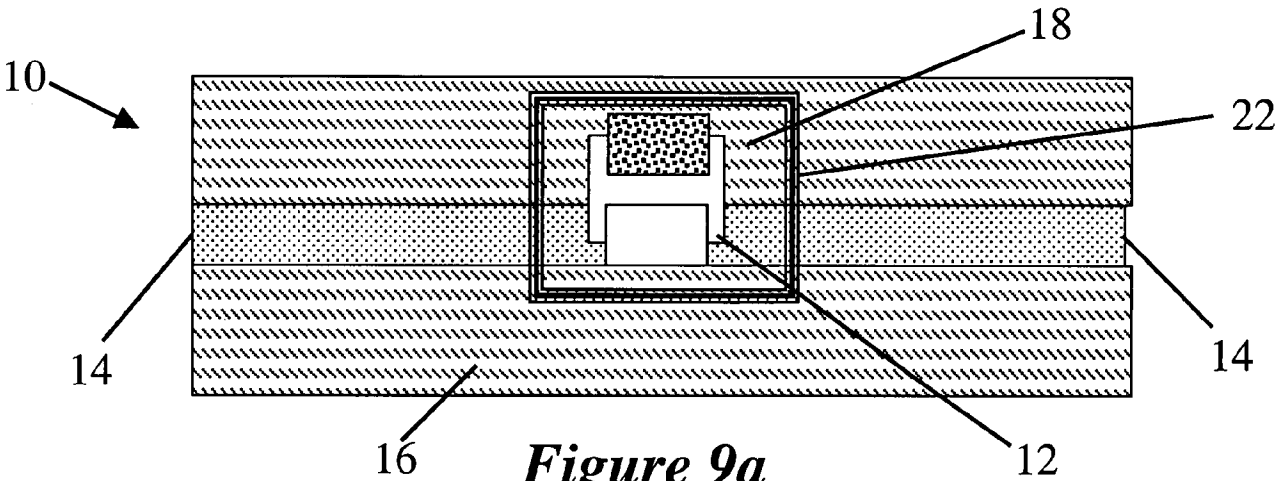
FIGS. 9*a* and 9*b* show a further alternate embodiment of the device of FIG. 3, in the "open" and "reset" positions, respectively.
Figure 9B:
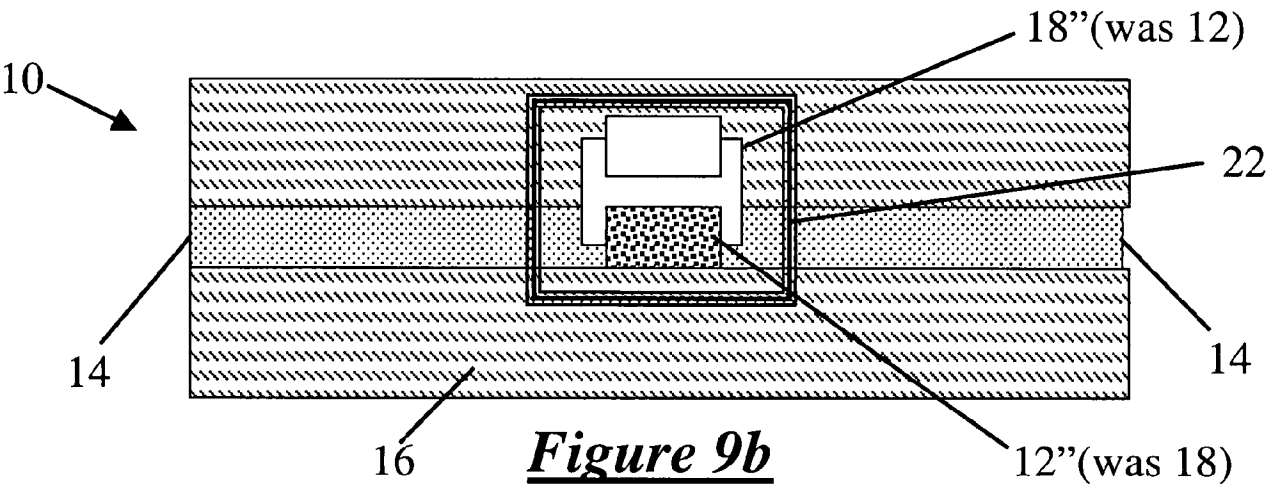

Referring to FIGS. 9*a* and 9*b*, in yet another embodiment, link 12 and reservoir 18 a provided in a re-settable cartridge 22 such that, once interrupter 10 is opened in operation (FIG. 9*a*), cartridge 22 may be repositioned, for example by manual removal and rotation in this example, to reset interrupter 10 by switching the locations of link 12 and reservoir 18, such that their functions and positions are reversed as shown in FIG. 9*b*. Automatic repositioning means (not shown) may alternately be provided.

Advantageously, with the present invention vapourization of the whole link does not occur as in prior art melting fuse-type interrupters and, therefore, the melt temperature and thus response time can be better predicted in design. In a standard prior art fuse, the overcurrent condition raises the temperature of the fuse material to its fusing or melting temperature. As the temperature increases, the resistance of the material also increases causing an increasing power dissipation in the material ($I^2R$), which causes an increase in temperature and so on. Thus, the prior art fuse is driving itself to ever higher temperatures at an ever accelerating rate until the power dissipation is reduced or eliminated. At some point, a break occurs in the conductive path, which typically causes an arc, particularly in relatively high current situations. This causes local vapourization of the conductor which facilitates sustaining the arc, which spreads away from the initial break point vapourizing more material as it progresses, until the voltage needed to sustain a current flow through the now long arc is not available from the external circuit, and the arc becomes quenched. Thus vapourization and arcing are relatively uncontrolled in the prior art, and thus response time and operability is adversely affected. The present invention provides an active pumping effect to minimize the effect of vapourization on arcing, and minimize arcing, which improves (i.e. reduces) responses time.

Another advantage is that the interrupter according to the present invention may be provided, by design, with an electrical resistance which is lower than possible in the prior art because the initial cross-section of the link 12 (i.e. initial conduction area) has less influence on the threshold current than prior art fuses, because the conduction area is reduced as the link 12 progressively melts.

The above description is meant to be exemplary only, and one skilled in the art will recognize and changes may be made to the embodiments described without departing from the scope of the invention disclosed. For example, the reservoir(s) need not be empty prior to the fuse activating, but rather the reservoirs may be filled with another material which vacates the reservoirs upon fuse activation, or otherwise is able to admit a sufficient volume of the link 12 to permit interrupter 10 to open the circuit. The function of the reservoir may be served by any means which permits the conductor to be moved away from its initial position to thereby open the circuit. Insulator 16 need not be provided, or may be altered as desired. The link 12 may only partially melt to activate interrupter 10. One or more links 12 may be provided in interrupter 10, of the same or different materials, as desired, arranged in parallel or in serial, as desired. Interrupter 10 need not have a linear shape, nor the rudimentary geometric configuration described, but rather any suitable fuse configuration may be used. Although a meltable solid conductor is discussed through, a suitable conductor which flows in response to magnetic pressure may be used. And although preferred, the threshold current need not be the means by which the conductor is provided in a flowable state, as alternate methods of providing a flowable conductor are available, such as providing separate heating means or providing a conductor which is otherwise independently in a flowable state. Application of the present principles is certainly not limited to the control of electric machines or use on aircraft. Still other modifications will be apparent to those skilled in the art, in light of a review of this disclosure which do not fall outside the scope of what was invented, and therefore such modifications are intended to fall within the scope of the appended claims, and their respective equivalents.

I claim:

1. A current interrupter for an electrical circuit, the interrupter adapted to open when a threshold current passes therethrough, the interrupter comprising a flowable conductor adapted for connection to the circuit, the conductor having a cross-sectional area, wherein the conductor cross-sectional area is sized relative to the threshold current such that a sufficient magnetic pressure is generated in the conductor to thereby force the conductor to flow, said flow being sufficient to thereby open the circuit.

2. The current interrupter of claim 1 wherein the conductor is solid during a normal operating temperature of the electrical circuit and flowable at a temperature above said normal operating temperature.

3. The current interrupter of claim 1 wherein said flow flows substantially independent of any gravity effect on the flow.

4. The current interrupter of claim 1 wherein the conductor is a eutectic material.

5. The current interrupter of claim 1 wherein the current interrupter additionally comprises at least one reservoir for receiving said flow.

6. The current interrupter of claim 5 wherein the reservoir is configured such that the conductor cannot fully flow into the reservoir under the action of gravity alone.

7. The current interrupter of claim 5 wherein the conductor has a core and an axial direction, and wherein the reservoir communicates directly with the conductor core and is adapted to permit conductor material to flow axially from a core region into the reservoir.

8. A current interrupter for an electrical circuit, the interrupter adapted to open when a threshold current passes therethrough, the interrupter comprising: pressure means for forcing a flowable conductor connected to the circuit to flow sufficiently to thereby open the circuit, said pressure means comprising a conductor and a threshold current, the conductor sized and composed of a material such that the threshold current passing through the conductor generates a temperature and a forcing pressure sufficient to force said flow, said forcing pressure having a greater motive effect on said flow than a gravitational effect on said flow.

9. The current interrupter of claim 8 wherein the current interrupter has said pressure means fir opening the circuit and is free from any other means of opening the circuit.

* * * * *

UNITED STATES PATENT AND TRADEMARK OFFICE

CERTIFICATE OF CORRECTION

PATENT NO. : 7,023,307 B2
APPLICATION NO. : 10/701525
DATED : April 4, 2006
INVENTOR(S) : Kevin Allan Dooley It is certified that error appears in the above-identified patent and that said Letters Patent is hereby corrected as shown below:

In the claims:

claim 9, column 10, line 27, delete “fir” and insert --for--

Signed and Sealed this

Eighth Day of August, 2006

JON W. DUDAS
*Director of the United States Patent and Trademark Office*